United States Patent [19]

Revèrend et al.

[11] 4,070,835

[45] Jan. 31, 1978

[54] DEVICE INTENDED FOR THE HOOKING OF PANELS ON A WALL IN ORDER TO CONSTITUTE A COVERING ON THIS WALL

[75] Inventors: Roger Revèrend; Yves Cochin, both of Angers, France

[73] Assignee: Safama, Angers, France

[21] Appl. No.: 712,765

[22] Filed: Aug. 9, 1976

[51] Int. Cl.[2] ..... E04B 2/88

[52] U.S. Cl. ..... 52/235; 52/94; 52/122; 52/486

[58] Field of Search ..... 52/122, 126, 94, 96, 52/235, 479, 385, 486, 487, 58, 60, 62, 508, 510

[56] References Cited

U.S. PATENT DOCUMENTS

| | | | |
|---|---|---|---|
| 826,904 | 7/1906 | Spelman | 52/487 X |
| 2,971,616 | 2/1961 | Bayley, Jr. | 52/235 X |
| 3,110,131 | 11/1963 | Jeffress | 52/235 X |
| 3,350,830 | 11/1967 | Smith, Jr. et al. | 52/487 X |
| 4,009,549 | 3/1977 | Hala | 52/235 X |

FOREIGN PATENT DOCUMENTS

| | | | |
|---|---|---|---|
| 2,353,723 | 5/1975 | Germany | 52/94 |
| 1,659,338 | 1/1971 | Germany | 52/96 |
| 2,208,194 | 9/1973 | Germany | 52/235 |
| 2,412,684 | 9/1975 | Germany | 52/94 |
| 2,006,641 | 8/1971 | Germany | 52/235 |
| 2,437,073 | 2/1976 | Germany | 52/235 |
| 2,049,219 | 4/1972 | Germany | 52/235 |
| 2,356,943 | 8/1975 | Germany | 52/60 |
| 725,690 | 11/1966 | Italy | 52/235 |
| 324,346 | 12/1929 | United Kingdom | 52/486 |

*Primary Examiner*—Leslie Braun
*Attorney, Agent, or Firm*—Diller, Brown, Ramik & Wight

[57] ABSTRACT

A mounting assembly for fixing a wall covering comprised of a plurality of panels on a wall comprises a support member which is fastened to the wall and a panel bearing element secured to each panel and an improved profiled structural element including a main web, a first groove disposed on one side of the main web for receiving the support member and a pair of second grooves disposed on the opposite side of the main web, each second groove receiving one panel bearing member. The upper of the second grooves may support the lower part of an upper panel and the lower of the second grooves the upper part of a lower panel. The upper of the second grooves may alternatively support a special panel bearing element for a panel angled with respect to panels generally parallel to the wall.

7 Claims, 5 Drawing Figures

DEVICE INTENDED FOR THE HOOKING OF PANELS ON A WALL IN ORDER TO CONSTITUTE A COVERING ON THIS WALL

BACKGROUND OF THE INVENTION

The present invention relates to a device intended for the hooking of panels on a wall in order to constitute a covering on this wall.

It is well-known that difficulties occur when applying a covering to a wall, for example a wall made from concrete.

The difficulties reside mainly in the fact that the covering is not generally affixed to the wall but to a framework fixed by bedding in the wall.

Apart from the fact that such a procedure is not very practical and takes a long time, specialized labour is required in order to carry out this work by virtue of the fact that, during the course of execution, it is very often necessary to make adjustments in order that once finished, the assembly is nicely flat.

SUMMARY OF THE INVENTION

The object of the present invention is to rationalize the fitting of a covering on any wall, and for this purpose it proposes a device which is easily and rapidly used, resulting particularly in appreciable saving on time, and at a low prime cost.

A device according to the invention for fixing a covering consisting of panels on any wall, is characterized by the use of a profiled element which comprises on one face of one web a groove for hooking engagement on a support adapted to be fixed to the wall, and on another face a pair of grooves into which can be fitted tongues disposed in bearer elements on which the panels are fixed.

There are three types of bearer elements: a first type is intended to be associated with the lower part of a facing panel to ensure fixing of the panel on a profiled element while allowing it expansion; a second type is intended to be associated with the upper part of a panel in order to ensure its suspension by co-operation with another profiled element; a third type is more particularly intended to carry panels which are disposed in a different plane, for example support covering or other panels.

Finally, and where the fixing of small panels on the wall is concerned, for example the covering of reveals or the undersides of lintels over openings, it is intended to effect fitment by means of angle members provided with regulating means.

Thus, with a minimum of elements, it is a simple matter to cover anywall, for example a facade of a building, with a perfectly flat covering even if the facade itself has defects in flatness, because the device according to the invention provides particularly easy adjustment facilities which mean that whatever the circumstances it is possible to locate the panels in an adequate position.

Embodiments of the invention will now be described, by way of example, with reference to the accompanying drawings.

DESCRIPTION OF THE PREFERRED EMBODIMENTS

Figure 2:
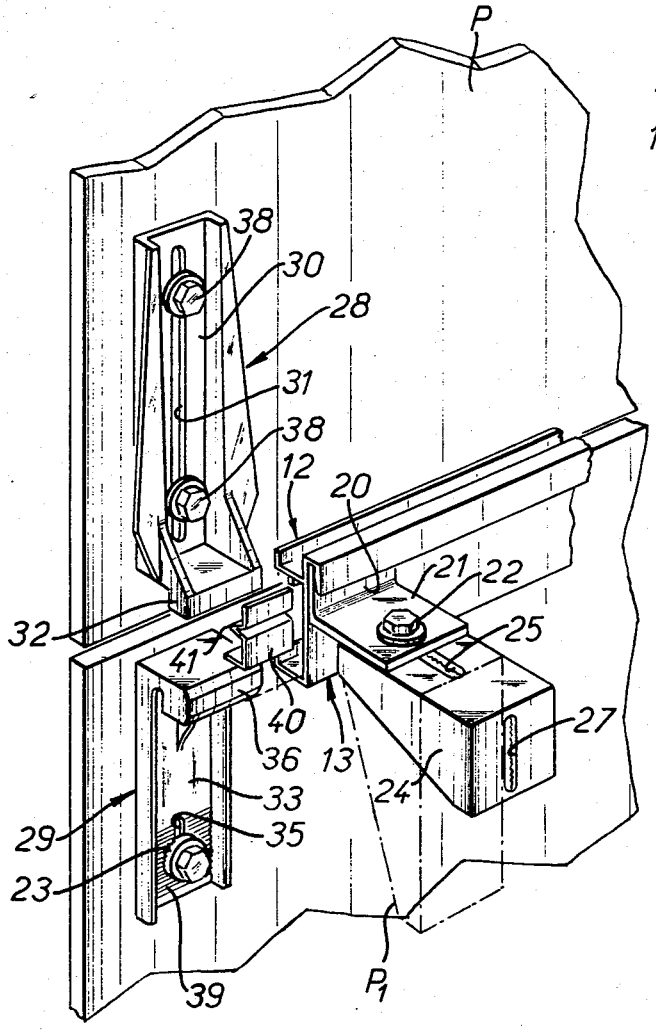
FIG. 2 is a perspective view of the same structure in the direction of the arrow F in FIG. 1.
Figure 1:
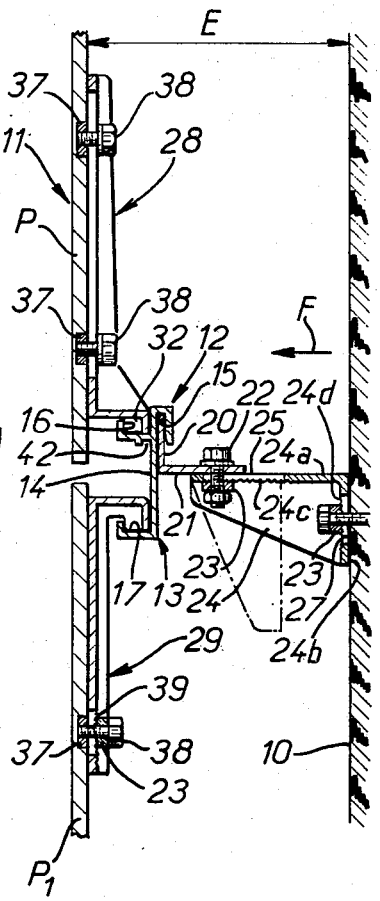
FIG. 1 shows, in partial vertical section, the connection of two panels to a vertical wall, for example a facade wall, the upper part of one panel and the lower part of the other being shown.

With reference to FIGS. 1 and 2, reference numeral 10 partially indicates a wall surface, for example a facade wall and shows a covering 11 consisting of a plurality of panels P, $P_1$ which are held by a device generally indicated as 12.

The device 12 according to the invention, essentially comprises a profiled element 13 having, in cross-section, on one face of a web 14 a groove 15 for hooking engagement while on the other face it has a pair of fitting grooves 16, 17, which extend longitudinally in the vicinity of each of the edges of the profile member 13.

The profile member 13 is adapted to be hooked by its hooking groove 15, onto each of a plurality of support elements rigid with the walls 10, i.e. onto the free end of a vertical arm 20 of an angle member, the other arm 21 of which is connected to a bracket 24.

The bracket 24 has a large arm **24*a* and a small arm 24*b* and it may be fixed to the wall 10 by embedding one or other of its arms, according to the space E between the wall and the panels which it is desired to obtain. Each of the aforesaid arms 20, 21 has an oblong aperture 25, 27 for the passage of fixing means such as bolts 22; in this respect, it should be noted that each bolt acts on a notched washer 23, the notches of which are adapted to co-operate with ridges 24*c*, 24*d* provided on the inner faces of the brackets 24** on either side of the axis of the oblong apertures.

By reason of the configuration of the bracket 24, it is possible to secure it to the wall 10 by either of the arms, which results in initial spacing, after which, prior to final fixing, it is possible to carry out adjustments both of the bracket 24 in respect to the wall 10 and of the angle member 20, 21 in respect of the bracket 24, by reason of the oblong apertures 25, 27.

Moreover, any sliding which may occur between the bracket 24 and the wall 10, and between the angle member and the bracket, are made impossible by the pressure of the notched washer 23, the notches of which co-operate with the ridges **24*c*, 24*d*** on the bracket.

With such arrangements, it is possible to equip a wall with a plurality of support elements, obtaining a perfect inherent flatness of the vertical arms 20 of the angle members, even if the wall 10 has defects in inherent flatness, as is often the case.

In the drawings, the broken lines indicate the other possible position of the brackets 24.

The device also comprises bearer elements of two types generally indicated at 28 and 29.

The first type 28 of these bearer elements adapted to be attached to the lower part of the panels, is constituted by a member of elongated form having a sole plate 30 in which there is a longitudinal aperture 31 and a fixing member 32 which is intended to closely fit within the upper groove 16 in one of the profiled members 13.

With regard to the second type of bearer element 29, adapted to be attached to the upper part of the panels, it likewise has an elongated shape with a sole plate 33 in which there is a longitudinal aperture 35, while a hooking member 36 formed by a rebate is adpated to closely fit within the lower groove 17 of a profile member 13. The longitudinal apertures 31, 35 previously mentioned are intended to allow possible adjustments of the panels with respect to the bearer elements, and it will be noted that on either side of the aperture 35 of the bearer element 29 and at right-angles to the axis of this aperture there are ridges 39 adapted to cooperate with an anchoring plate 23, intended to avoid the panel slipping vertically once it has beed placed in position.

As can be seen, each panel is supported at its lower end and through the fixing member 32 which rests in the groove 16 of the profiled element, while at its upper part it is hooked into and suspended from the groove 17 in the profiled element 13 by the hooking element 36 of the element 28, so that the panels retain a degree of freedom which allows for possible subsequent expansion.

It should be noted that the panels P are provided with inserts 37 (FIG. 1) positioned at the time of manufacture to co-operate with the connecting screws 38; each of the panels advantageously has two top bearer elements 28 and two bottom bearer elements 29.

In view, on the one hand, of the various possibilities of adjusting the positioning of the profiled element 13 with respect to the face of the wall 10, and on the other, the possibilities of adjusting the position of the panels with respect to the bearer elements, it will be appreciated that the positioning of covering panels P, $P_1$ is greatly facilitated in comparision with prior techniques.

With a view to preventing the panels sliding horizontally, it is envisaged to provide immoblizing means consisting of a clamp 40, (FIG. 2) the terminal edges of which are situated one on either side of a central resilient bend 41 and are adapted to bear respectively on the outside of the hooking member 36 and into a groove 42 disposed on the outer face of the lower wall of the groove 16.

In order not to inhibit horizontal expansion of the panels, advantageously only a single clamp is provided per panel, its width being less than that of the member 36.

With such means, it is possible therefore to produce coverings by fitting the wall with profiled elements 13, then by fitting the panels with bearer elements whereupon the panels which are thus equipped can be coupled to the profiled elements 13.

It should be noted that a space E is lest between the wall and the inside face of the panels; this space is advantageously utilized for the fitment of insulation of any suitable type, not shown in the drawings.

In the case of a facade consisting of, for example, openings, the lintels etc. which support the bays should preferably likewise have a covering.

Figure 4:
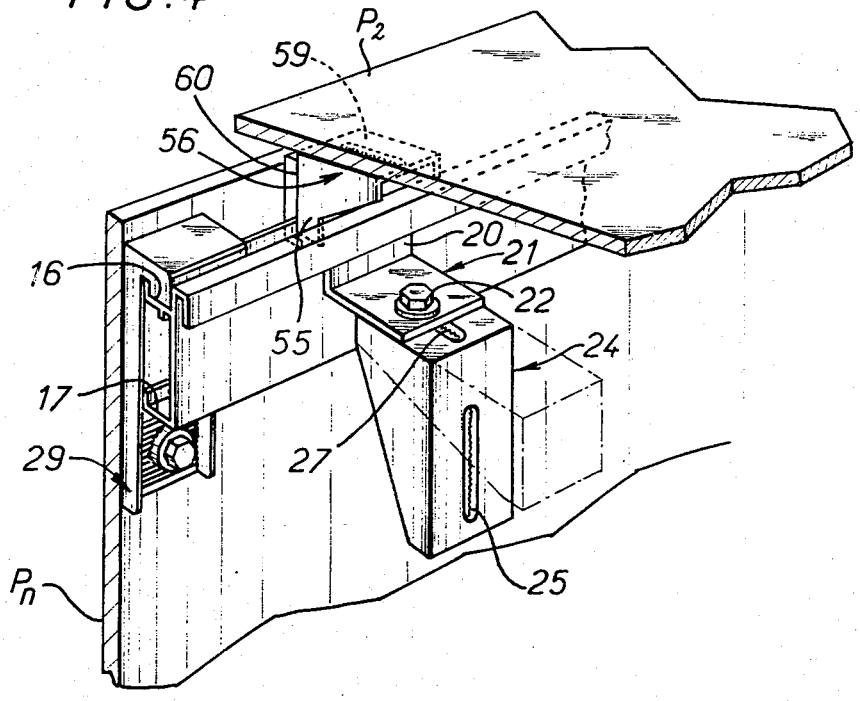
FIG. 4 is a partial perspective view of the structure shown in FIG. 3.
Figure 3:
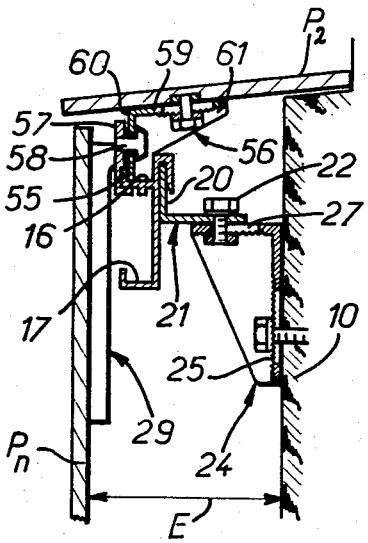
FIG. 3 shows a vertical section through the connection of a panel on a support.

An example of a covering of a bay support is shown in FIGS. 3 and 4.

In this example, a support covering panel $P_2$ overhangs the space E and a facade panel $P_n$.

The same references have been used to designate elements similar to those in the previous embodiment and it will be seen that the groove 16 in the profiled member 13 receives a fixing member of a bearer element 29, and a member 55 provided in a third type of bearer element 56, which is coupled to the profiled element 13 by means of a locking plate 57 and a screw 58.

It will be noted tht the bearer element 56 comprises a plate 59, a flange 60, and webs 61, the plate forming with the flange 60 any angle of inclination, for example of the order of 6° with respect to the horizontal, on the outer face of which the panel $P_2$ will rest, while in the case in question, the member 55 is to a certain extent orientated and is formed by an appropriate cut-out in the webs 61.

The aforesaid panel $P_2$ is fixed to the plate 59 of the bracket by screwing, this plate having ridges adapted to co-operate with a ridged plate in order to prevent any sliding of the panels particularly following the effects of vibrations.

Figure 5:
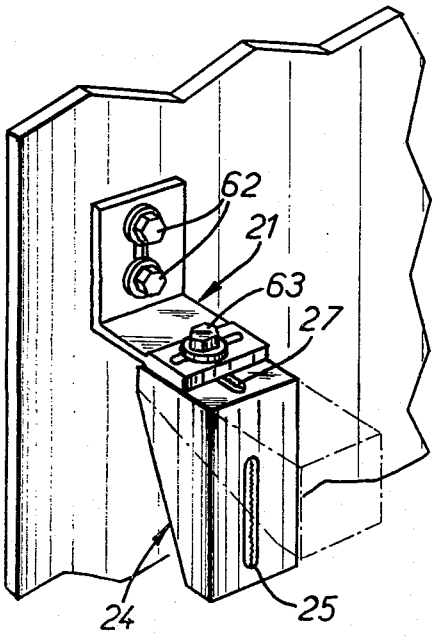
FIG. 5 shows a perspective view of the fixing of a panel which is of small dimensions.

When small areas of wall have to be provided with a covering, this latter is attached point by point as can be seen clearly and particularly in FIG. 5.

To do this, an angle member 21 and a bracket 24 are used; the panel is connected to the angle 21 by screws 62 which are screwed into inserts provided in the panel, while the angle is connected to the bracket by bolts 63 advantageously with the inter-position of a notched washer (not shown in the drawings), but the fitment of which is similar to that shown in FIG. 1.

From the foregoing, therefore, it emerges that with a minimum of basic elements it is possible to place under excellent conditions and at a certain distance from a wall a covering consisting of a plurality of panels.

What is claimed is:

1. A mounting assembly for fixing a wall covering comprised of a plurality of panels on a wall, said mounting assembly comprising for each said panel plural support members in aligned spaced relation having means for attachment on the wall, an upper and a lower set of panel bearing elements having means for securement to each said panel, an elongate one-piece structural element including a main web, a first longitudinal groove disposed on one side of said main web and hooked onto said support members in longitudinally adjustable relation with respect thereto, a pair of upper and lower second longitudinal grooves disposed on the opposite side of said main web, each said second groove longitudinally adjustably receiving one of said sets of panel bearing elements, said upper second longitudinal groove receiving said lower set of panel bearing elements of an upper panel and said lower second longitudinal groove receiving said upper set of panel bearing elements of a next lower panel.

2. The mounting assembly according to claim 1, wherein each support member comprises an angle member, a bracket, means adjustably securing said angle member on said bracket, said means for attachment of said support member on the wall including means adjustably mounting said bracket on the wall, and a free end of one leg of said angle member being complementary to and received in said groove for hooking said structural element thereon.

3. The mounting assembly according to claim 1, further comprising additional panel bearing elements for supporting panels in a plane angled relative to that defined by the wall covering, said additional panel bearing elements having a nose portion received in and cooperating with the upper of said pair of second grooves.

4. The mounting assembly according to claim 3, further comprising clamping means for clamping said additional bearing element in the upper of said second grooves, said clamping means comprising a locking plate and fastening means.

5. The mounting assembly according to claim 4, wherein said additional bearing element has a panel mounting base plate angled with respect to the general plane of said wall covering panels.

6. A mounting assembly according to claim 1, wherein said first groove is defined by a back portion spaced from and parallel to said main web and generally along one edge of said main web, said second grooves being disposed proximate to the respective edges of said main web; said one edge thereof defining in cross section a horizontally disposed generally S-shaped portion including said first groove, said second groove which is proximate to said one edge of said main web, and a part of said main included therebetween.

7. A mounting assembly according to claim 1, further including clamping means for preventing said upper and lower panel bearing members from longitudinally displacement with respect to said elongate structural element, said clamping comprising a resilient member bearing against that portion of said structural element defining said upper second groove and that one of said upper panel bearing members received in said lower second groove.

* * * * *